US007511566B2

(12) United States Patent
Matsuda

(10) Patent No.: US 7,511,566 B2
(45) Date of Patent: Mar. 31, 2009

(54) SEMICONDUCTOR CIRCUIT WITH POSITIVE TEMPERATURE DEPENDENCE RESISTOR

(75) Inventor: Atsushi Matsuda, Kawasaki (JP)

(73) Assignee: Fujitsu Microelectronics Limited, Tokyo (JP)

( * ) Notice: Subject to any disclaimer, the term of this patent is extended or adjusted under 35 U.S.C. 154(b) by 70 days.

(21) Appl. No.: 11/168,439

(22) Filed: Jun. 29, 2005

(65) Prior Publication Data

US 2006/0208761 A1 Sep. 21, 2006

(30) Foreign Application Priority Data

Mar. 18, 2005 (JP) ..... 2005-079947

(51) Int. Cl.
*G05F 1/10* (2006.01)

(52) U.S. Cl. ..... 327/539

(58) Field of Classification Search ..... 327/539, 327/512, 513, 535, 537, 538, 543
See application file for complete search history.

(56) References Cited

U.S. PATENT DOCUMENTS 5,666,046 A * 9/1997 Mietus ..... 323/313
6,052,020 A * 4/2000 Doyle ..... 327/539
6,075,407 A * 6/2000 Doyle ..... 327/539
6,563,371 B2 * 5/2003 Buckley et al. ..... 327/539
6,642,778 B2 * 11/2003 Opris ..... 327/539
6,744,304 B2 * 6/2004 Egerer et al. ..... 327/540
6,930,538 B2 * 8/2005 Chatal ..... 327/539
7,170,336 B2 * 1/2007 Hsu ..... 327/539
7,224,209 B2 * 5/2007 Hsu ..... 327/538
7,224,210 B2 * 5/2007 Garlapati et al. ..... 327/539
2005/0040803 A1 2/2005 Ueda

FOREIGN PATENT DOCUMENTS

JP 2000-323939 A 11/2000
JP 2004-234477 A 8/2004

* cited by examiner

*Primary Examiner*—Jeffrey S Zweizig
(74) *Attorney, Agent, or Firm*—Arent Fox LLP

(57) ABSTRACT

A band gap reference circuit is configured by connecting an emitter of a transistor, having the base and the collector thereof grounded, to an internal circuit, and by connecting an emitter of another transistor, having the base and the collector thereof grounded, to the internal circuit via a resistor having a positive temperature dependence with respect to the absolute temperature, so as to ensure that a constant output current with a small temperature dependence can be generated, without providing any voltage-current conversion circuit and without generating a constant output voltage, while suppressing expansion in the circuit scale but based on a circuit configuration allowing lowering in the power source voltage.

9 Claims, 3 Drawing Sheets

SEMICONDUCTOR CIRCUIT WITH POSITIVE TEMPERATURE DEPENDENCE RESISTOR

CROSS-REFERENCE TO RELATED APPLICATIONS

This application is based upon and claims the benefit of priority from the prior Japanese Patent Application No. 2005-079947, filed on Mar. 18, 2005, the entire contents of which are incorporated herein by reference.

BACKGROUND OF THE INVENTION

1. Field of the Invention

The present invention relates to a semiconductor circuit generating a constant current with a small temperature dependence, preferably used as a reference current circuit or the like.

2. Description of the Related Art

Conventionally, constant current output insensitive to temperature environment, or temperature-independent current output, has generally been obtained by combining a circuit called "band gap reference circuit" with a voltage-current conversion circuit. The band gap reference circuit is a reference voltage circuit capable of generating a constant output voltage without temperature dependence. A constant output current can be obtained by converting the constant output voltage of the band gap reference circuit by a voltage-current conversion circuit.

FIG. 5 is a circuit diagram showing a configuration of a reference current circuit 50 configured using a band gap reference circuit and a voltage-current conversion circuit. The reference current circuit 50 is configured, as shown in FIG. 5, as having amplifiers 51, 53, pnp-type bipolar transistors Q51 to Q53, p-type MOS (metal oxide semiconductor) transistors M51 to M55, and resistors R51 to R53.

Bases and collectors of the transistors Q51 to Q53 are grounded (connected to the ground potential). An emitter of the transistor Q51 is connected to a drain of the transistor M51, and an emitter of the transistor Q52 is connected via a resistor R51 to a drain of the transistor M52. An emitter of the transistor Q53 is connected via a resistor R52 to a drain of the transistor M53.

Gates of the transistors M51 to M53 are commonly connected to the output end of the amplifier 51. Input ends of the amplifier 51 are connected respectively to an interconnection point of the emitter of the transistor Q51 and the drain of the transistor M51, and to an interconnection point of the resistor R51 and the drain of the transistor M52. Sources of the transistors M51 to M55 are connected to a power source circuit 52, from which power source voltage VCC is supplied.

A drain of the transistor M54 is grounded through the resistor R53. Gates of the transistors M54, M55 are commonly connected to the output end of the amplifier 53. Input ends of the amplifier 53 are connected respectively to an interconnection point of the resistor R52 and a drain of the transistor M53, and to an interconnection point of the resistor R53 and a drain of the transistor M54. A constant output current Iout is output from a drain of the transistor M55.

In FIG. 5, ratio of size of the transistor Q51 and transistor Q52 is set to 1:N (N>1), and ratio of size of the transistor M51 and transistor M52 is set to m:1 (m>1). Ratio of size of the resistor R51 and resistor R52 is set to 1:k (k>1). For example, the transistor Q52 can be realized by using N transistors having the same size with the transistor Q51, and the transistor M51 can be realized using m transistors having the same size with the transistor M52. Similarly, the resistor R52, for example, is realized by using k resistors having the same size with the resistor R51.

It is generally known that base-to-emitter voltage $V_{BE}$ of bipolar transistor has a negative temperature characteristic of approximately −2 mV/° C. Defining now base-to-emitter voltages of the transistors Q51, Q52 as $V_{BE1}$ and $V_{BE2}$, respectively, difference therebetween $\Delta V_{BE}(=V_{BE1}-V_{BE2})$ is known to show a positive temperature characteristic. As is obvious from FIG. 5, the interconnection point of the emitter of the transistor Q51 and the drain of the transistor M51, and the interconnection point of the resistor R51 and the drain of the transistor M52 have the same potential, so that the resistor R51 is exposed to potential difference $\Delta V_{BE}$, and current flowing through the resistor R51 also shows a positive temperature characteristic by contribution of the potential difference $\Delta V_{BE}$.

FIG. 5 therefore teaches that a proper selection of a value of k so as to equalize temperature-dependent amounts of changes (absolute values) in the base-to-emitter voltage $V_{BE}$ of the transistor Q53 and in ($\Delta V_{BE}\times k$) at the resistor R52 (or so as to cancel the temperature-dependent influences) makes it possible to obtain an output voltage of approximately 1.2 V in a temperature-independent manner. Successive conversion of the constant output voltage without temperature dependence by a voltage-current conversion circuit, which comprises the amplifier 53, transistors M54, M55 and the resistor R53, results in output of a constant output current Iout.

In this configuration of the circuit, based on use of the band gap reference circuit, intended for obtaining a constant output current with a small temperature dependence, it is necessary to additionally provide a voltage-current conversion circuit, as described in the above, in order to obtain a constant output current, because use of a general band gap reference circuit can only provide a circuit generating a constant output voltage.

A proposal has been made also on a band gap reference circuit as typically disclosed in Patent Document 1, operable at a low power source voltage. The circuit configured to generate a constant output voltage and to convert it into a constant output current, however, raises a difficulty in lowering the power source voltage, because elimination of the temperature dependence needs an output voltage of at least as high as approximately 1.2 V due to various physical conditions.

[Patent Document 1] Japanese Patent Application Laid-Open No. 2000-323939

SUMMARY OF THE INVENTION

It is an object of the present invention to enable generation of a constant output current with a small temperature dependence, while suppressing expansion in the circuit scale but based on a circuit configuration allowing lowering in the power source voltage.

A semiconductor circuit of the present invention comprises a first transistor and a second transistor respectively having both of bases and collectors thereof grounded, a resistor having one end connected to an emitter of the second transistor, an internal circuit is connected to an emitter of the first transistor and the other end of the resistor and makes to keep potential at the individual interconnection points at the same level by virtue of an internal feedback operation, and a third transistor supplied with an output from the internal circuit and outputs an output current to the external corresponding to the received output. The resistor has a positive temperature dependence with respect to the absolute temperature.

According to the present invention, it is made possible, without providing any additional voltage-current conversion circuit, to generate a constant output current with a small temperature dependence, by connecting the resistor having a positive temperature dependence so as to cancel a positive temperature dependence which resides in potential difference between base-to-emitter voltages of two transistors of the first and second transistors, as well as to suppress the circuit operation voltage to as low as 1.2 V or below because there is no need of generating a constant output voltage. It is therefore made possible to generate a constant output current with a small temperature dependence, while suppressing expansion in the circuit scale, and to lower the power source voltage.

DETAILED DESCRIPTION OF THE PREFERRED EMBODIMENTS

The following paragraphs will describe embodiments of the present invention referring to the attached drawings.

Figure 1:
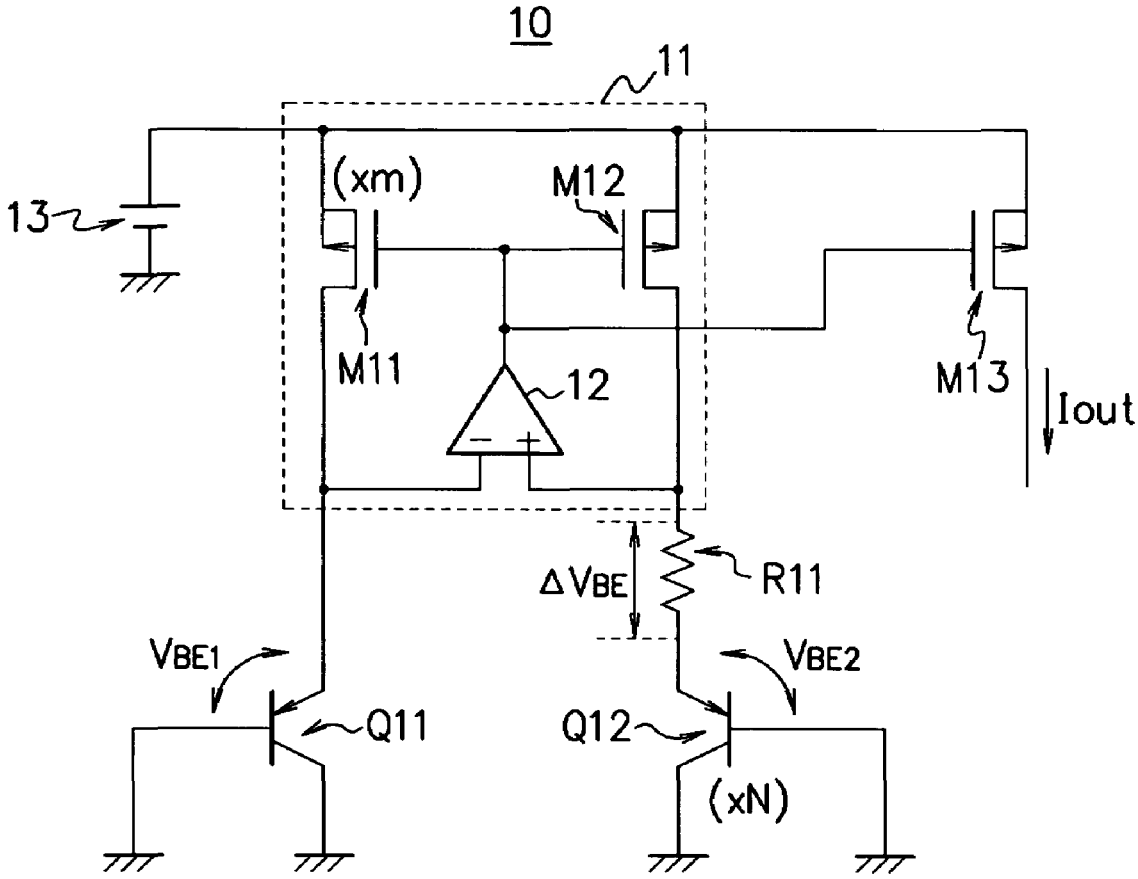
FIG. 1 is a circuit diagram showing an exemplary configuration of a reference current circuit in an embodiment of the present invention.

FIG. 1 is a circuit diagram showing an exemplary configuration of a reference current circuit 10 applied with the semiconductor circuit according to an embodiment of the present invention. As shown in FIG. 1, the reference current circuit 10 makes use of a band gap reference circuit, comprising pnp-type bipolar transistors Q11, Q12 respectively having both of bases and collectors thereof grounded (connected to the ground potential), a resistor R11 having one end connected in series to an emitter of the transistor Q12, and having a positive temperature dependence (temperature characteristic) with respect to the absolute temperature, an internal circuit 11 connected to an emitter of the transistor Q11 and the other end of the resistor R11, and a p-type MOS (metal oxide semiconductor) transistor M13 outputting an output current Iout corresponding to an output of the internal circuit 11.

The internal circuit 11 has p-type MOS transistors M11, M12 having their sources connected to a power source circuit 13 supplying power source voltage VCC, and an amplifier (operation amplifier) 12 having a pair of input ends thereof respectively connected to drains of the transistor M11, M12, and having an output end connected to gates of the transistors M11, M12.

More specifically, the bases and collectors of the transistors Q11, Q12 are grounded, the emitter of the transistor Q11 is connected to the drain of the transistor M11, and the emitter of the transistor Q12 is connected via the resistor R11 to the drain of the transistor M12. The input ends of the amplifier 12 are connected respectively to an interconnection point of the emitter of the transistor Q11 and the drain of the transistor M11, and to an interconnection point of the resistor R11 and the drain of the transistor M12. The output end of the amplifier 12 is connected to the gates of the transistors M11 to M13.

The sources of the transistors M11 to M13 are connected to the power source circuit 13, from which power source voltage VCC is supplied. The transistors M11 to M13 function as current sources corresponding to output of the amplifier 12. The emitter of the transistor Q11 is connected to the drain of the transistor M11 as a current output end of a first current source, and the emitter of transistor Q12 is connected via the resistor R11 to the drain of the transistor M12 as a current output end of a second current source. Output current Iout is output from the drain of the transistor M13 as a current output end of a third current source.

In this embodiment, ratio of size of the transistor Q11 and transistor Q12 is set to 1:N (N>1), and ratio of size of the transistor M11 and transistor M12 is set to m:1 (m>1). For example, the transistor Q12 can be realized using N transistors having the same size with the transistor Q11, and the transistor M11 is realized using m transistors having the same size with transistor M12. The transistors Q11, Q12, and the transistors M11, M12 may be configured also so as to attain the above-described predetermined ratio of size, by appropriately controlling ratio of area of the emitters, or ratio or gate width/gate length, without being limited to the above-described design.

Assuming now base-to-emitter voltage of the transistors Q11, Q12 as $V_{BE1}$, $V_{BE2}$, respectively, difference $\Delta V_{BE}$ therebetween can be expressed as below:

[Mathematical Formula 1]

$$\begin{aligned}\Delta V_{BE} &= V_{BE1} - V_{BE2} \\ &= V_T \times \ln(mN)\end{aligned} \tag{1}$$

In the equation (1) in the above, m and N represent above-described ratio of size of the transistor M11 to the transistor M12, and ratio of size of the transistor Q12 to the transistor Q11. $V_T$ represents heat voltage, and is expressed as $V_T$=kT/q, where k is Boltzmann's constant, T is absolute temperature, and q is amount of charge of an electron.

Resistivity value R(T) of the resistor R11 having a positive temperature dependence is now defined as follows:

[Mathematical Formula 2]

$$R(T)=R_r\times(1+\alpha(T-298)) \tag{2}$$

In the equation (2), T is absolute temperature, α is temperature coefficient of the resistor R11, and $R_r$ is resistivity value of the resistor R11 at T=298 [K]. According to the equation (2), the resistor R11 will have a resistivity value of 0 at absolute zero.

The interconnection point of the emitter of the transistor Q11 and the drain of the transistor M11, and the interconnection point of the resistor R11 and the drain of the transistor M12 have the same potential by virtue of a feedback operation of the internal circuit 11, so that the resistor R11 is applied with potential difference $\Delta V_{BE}$ expressed by the equation (1). As is obvious from FIG. 1, current flowing through the resistor R11 and output current Iout are equivalent. The output current Iout is then given as:

[Mathematical Formula 3]

-continued $$I = \frac{\Delta V_{BE}}{R(T)} = \frac{(kT/q)\times\ln(mN)}{R_r\times(1+\alpha(T-298))} = \frac{k}{qR_r}\times\ln(mN)\times\frac{T}{1+\alpha(T-298)} \quad (3)$$

Differentiation of the equation (3) by T gives the following:

[Mathematical Formula 4]

$$\frac{dI}{dT} = \frac{k}{qR_r}\times\ln(mN)\times\frac{1-298\alpha}{(1+\alpha(T-298))}$$

This teaches that the resistor R11 configured using a material capable of giving a temperature coefficient of $\alpha=(1/298)$ makes it possible to zero the temperature dependence of the output current Iout, and to obtain output current with no temperature dependence.

Cobalt silicide can be exemplified as one material suitable for composing the resistor R11 shown in FIG. 1. A poly-resistor using cobalt silicide (cobalt silicide resistor) adopted as the resistor R11 will give a temperature coefficient $\alpha$ of approximately $3\times10^{-3}$, which is very close to $(1/298)=3.36\times10^{-3}$.

Considering now a case with temperature T=298 [K]=25 [° C.] in the reference current circuit shown in FIG. 1, using a cobalt silicide resistor as the resistor R11, (dI/dT) can be written as:

[Mathematical Formula 5]

$$\frac{dI}{dT} = \frac{k}{qR_r}\times\ln(mN)\times(1-298\times3\times10^{-3}) = \frac{k}{qR_r}\times\ln(mN)\times(0.106) \quad (4)$$

The equation (4) divided by I expressed by the equation (3) gives:

[Mathematical Formula 6]

$$\left(\frac{dI}{dT}\right)\Big/I = \frac{0.106}{298} = 0.00036\%/°\text{ C.}$$

This indicates that use of cobalt silicide for the resistor R11 results in a drift of 0.00036% per 1° C. of the output current Iout. This level of drift reaches only as much as 0.036% even if the temperature should vary as much as 100° C., which is a level ignorable enough. Cobalt silicide is a material used for gate electrodes of transistors composing semiconductor integrated circuits such as LSIs, and is one of very suitable materials also in view of mass production. It is to be noted now that the description in the above merely shows one of specific examples of use of cobalt silicide resistor, and by no means limits any materials composing the resistor R11.

Figure 2A:
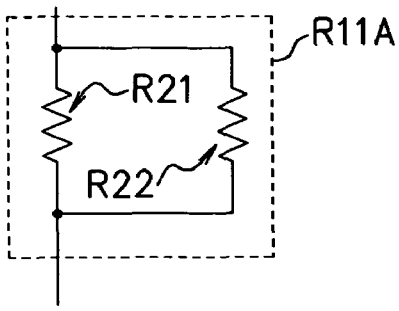
FIGS. 2A and 2B are drawings showing other exemplary configurations of the resistor shown in FIG. 1.
Figure 2B:
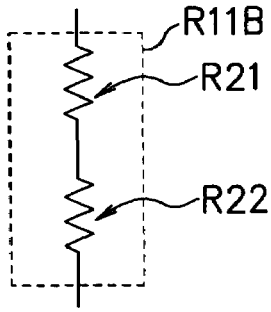

Although the resistor R11 in the reference current circuit according to this embodiment shown in FIG. 1 was expressed by a single circuit symbol, the resistor R11 is by no means limited to a single species of resistors, that is, resistors of identical characteristics. For example, it is also allowable, as respectively shown in FIGS. 2A and 2B, to use resistors R11A, R11B configured by connecting resistors R21, R22 differing in the temperature dependence in parallel or in series, respectively, in place of using the resistor R11. The number of types of the resistors connected in series or in parallel may be three or more, and it is still also allowable to combine the series connection and parallel connection. Even when the individual resistors have values of temperature coefficient $\alpha$ differing from 1/298, appropriate combination of the resistors so as to attain a temperature coefficient $\alpha$ of the resultant synthetic resistor to 1/298 makes it possible to reduce the temperature dependence of the output current Iout.

The next paragraphs will describe another exemplary configuration of the reference current circuit applied with the semiconductor circuit of this embodiment.

Figure 3:
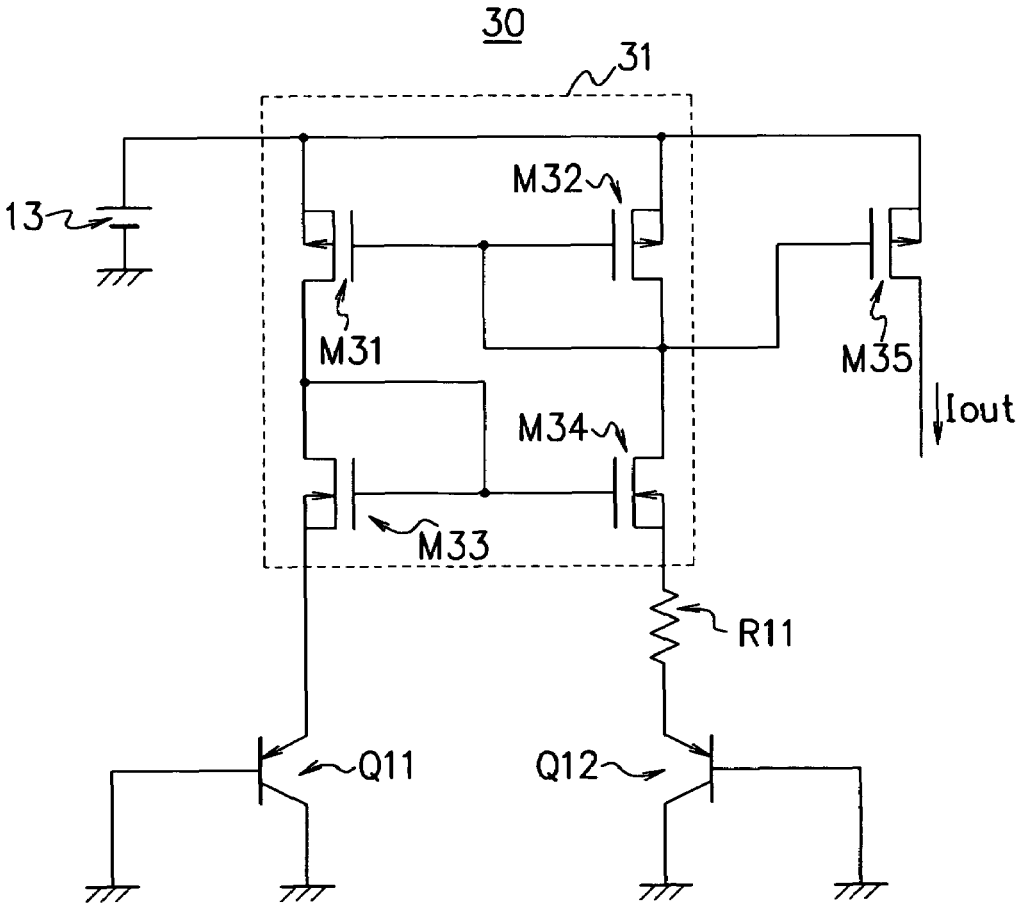
FIG. 3 is a circuit diagram showing another exemplary configuration of the reference current circuit in this embodiment.

FIG. 3 is a circuit diagram showing another exemplary configuration of the reference current circuit of this embodiment. In FIG. 3, any constituents having functions identical to those shown in FIG. 1 are given with the same reference numerals, without repeating the explanations therefor. A reference current circuit 30 shown in FIG. 3 differs from that shown in FIG. 1 only in configuration of the internal circuit.

An internal circuit 31 of the reference current circuit 30 has a CMOS configuration, comprising a p-type MOS transistor M31 and an n-type MOS transistor M33, connected in series between the power source circuit 13 (power source voltage VCC) and the emitter of the transistor Q11, and similarly has another CMOS configuration, comprising a p-type MOS transistor M32 and an n-type MOS transistor M34, connected in series between the power source circuit 13 (power source voltage VCC) and the resistor R11. In other words, two CMOS configurations connected in parallel are connected to the power source voltage VCC.

An interconnection point of a drain of the transistor M31 and a drain of the transistor M33 is connected to gates of the transistors M33, M34, and an interconnection point of a drain of the transistor M32 and a drain of the transistor M34 is connected to gates of the transistors M31, M32. The interconnection point of the drain of the transistor M32 and the drain of the transistor M34 is also connected to a gate of the p-type MOS transistor M35 having its source connected to the power source circuit 13 (power source voltage VCC) and outputting an output current Iout corresponding to an output of the internal circuit 31.

Operations of the reference current circuit 30 shown in FIG. 3 will not be explained since they are same with those of the reference current circuit 10 shown in FIG. 1.

Figure 4:
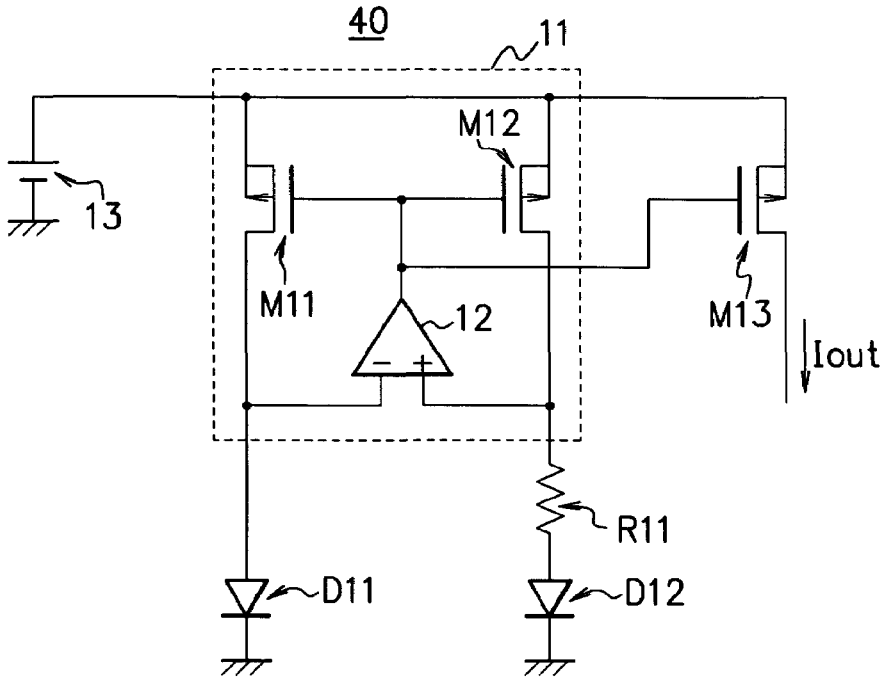
FIG. 4 is a circuit diagram showing a still another exemplary configuration of the reference current circuit in this embodiment.
Figure 5:
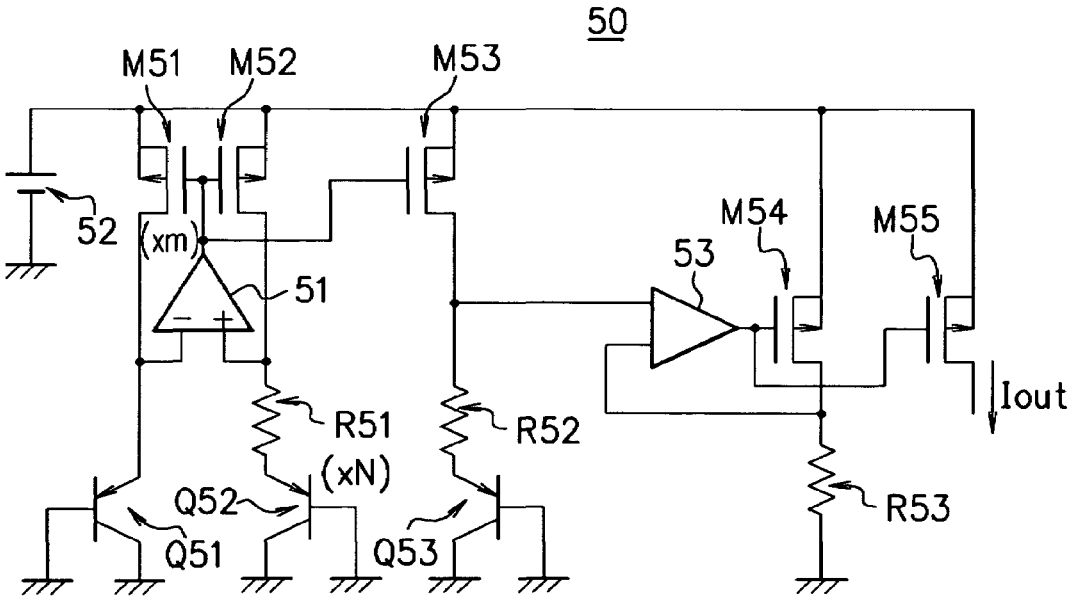
FIG. 5 is a circuit diagram showing a reference current circuit using a voltage-current conversion circuit.

FIG. 4 is a circuit diagram showing still another exemplary configuration of the reference current circuit of this embodiment. In FIG. 4, any constituents having functions identical to those shown in FIG. 1 are given with the same reference numerals, without repeating the explanations therefor. A reference current circuit 40 shown in FIG. 4 uses diodes D11, D12, in place of the transistors Q11, Q12 in the reference current circuit 10 shown in FIG. 1.

In the reference current circuit 40, an anode of the diode D11 is connected to the drain of the transistor M11, and an anode of the diode D12 is connected via the resistor R11 to the drain of the transistor M12. Cathodes of the diodes D11, D12 are grounded. Also this configuration of the circuit can realize the functions similar to those of the reference current circuit 10 shown in FIG. 1, because the diodes D11, D12 can function similarly to the transistors Q11, Q12 having their bases and collectors grounded.

The above-described examples shows merely exemplary cases, without limiting the present invention, and are applicable to any circuit configurations which are known as so-called band gap reference circuit.

As has been described in the above, this embodiments adopts the band gap reference circuit in which emitter of the transistor Q11, having its base and collector being grounded, is connected to the internal circuit, and the emitter of the transistor Q12, having its base and collector being grounded, is connected via the resistor, having a positive temperature dependence with respect to the absolute temperature, to the internal circuit. In other words, the band gap reference circuit is connected with the resistor R11 having a positive temperature dependence with respect to potential difference $\Delta V_{BE}$.

By providing the resistor R11 having a positive temperature dependence as described in the above, or in other words, by conferring a positive temperature dependence on the resistor R11, it is made possible to cancel a positive temperature dependence which resides in potential difference $\Delta V_{BE}$ between base-to-emitter voltages $V_{BE1}$, $V_{BE2}$ of the transistors Q11, Q12, and to thereby generate a constant output current having a small temperature dependence without additionally providing any voltage-current conversion circuit. Such design of directly obtaining the output current also makes it possible to suppress the circuit operation voltage to as low as 1.2 V or below, while successfully reducing the temperature dependence of the output current, without need of generating a constant output voltage. This consequently makes it possible to generate a constant output current with a small temperature dependence while suppressing expansion in the circuit scale, and to lower the power source voltage.

It is to be noted that all of the above-described embodiments are only and merely a portion of materialization of the present invention, and therefore should not be used for limitedly understanding the technical scope of the present invention. In other words, the present invention can be embodied in various modified forms without departing from the technical spirit and principal features thereof.

What is claimed is:

1. A semiconductor circuit comprising:

a first transistor and a second transistor respectively having both of bases and collectors thereof grounded;

a resistor having one end coupled to an emitter of said second transistor;

an internal circuit to which an emitter of said first transistor and the other end of said resistor are respectively coupled, so as to keep potential at the individual interconnection points at the same level by virtue of an internal feedback operation; and a third transistor supplied with an output from said internal circuit, and outputs a current to the external corresponding to the received output;

wherein said resistor has a positive temperature dependence with respect to the absolute temperature and cancels a positive temperature dependence which resides in a potential difference between a base-to-emitter voltage of said first transistor and a base-to-emitter voltage of said second transistor.

2. The semiconductor circuit according to claim 1, wherein said second transistor has a size N (N>1) times as large as a size of said first transistor.

3. The semiconductor circuit according to claim 1, wherein said resistor is configured using cobalt silicide.

4. The semiconductor circuit according to claim 1, wherein said resistor is configured by connecting a plurality of resistors differing in the temperature dependence in series and/or parallel.

5. The semiconductor circuit according to claim 1 wherein said internal circuit further comprises:

a fourth transistor and a fifth transistor respectively having sources supplied with power source voltage; and an amplifier having a pair of input ends connected to drains of said fourth and fifth transistors, and having an output end connected to gates of said third, fourth and fifth transistors.

6. The semiconductor circuit according to claim 5, wherein said fourth transistor has a size m (m>1) times as large as a size of said fifth transistor.

7. The semiconductor circuit according to claim 1, wherein said internal circuit further comprises:

a fourth transistor and a fifth transistor respectively having sources supplied with power source voltage; and a sixth transistor and a seventh transistor respectively having drains connected to drains of said fourth and fifth transistors wherein an interconnection point of drains of said fourth and sixth transistors is connected to gates of said sixth and seventh transistors, an interconnection point of drains of said fifth and seventh transistors is connected to gates of said third, fourth and fifth transistors, a source of said sixth transistor is connected to an emitter of said first transistor, and a source of said seventh transistor is connected to the other end of said resistor.

8. A semiconductor circuit outputting a constant current using a band gap reference circuit, including a resistor having a positive temperature dependence with respect to the absolute temperature, for canceling a positive temperature dependence which resides in a potential difference AVBE between base-to-emitter voltages in said band gap reference circuit, to thereby ensure output of the constant current.

9. A semiconductor circuit comprising:

a first diode and a second diode having the respective cathodes grounded;

a resistor having one end coupled to an anode of said second diode;

an internal circuit to which an anode of said first diode and the other end of said resistor are respectively coupled, so as to keep potential at the individual interconnection points at the same level by virtue of an internal feedback operation; and a transistor supplied with an output from said internal circuit, and outputs a current to the external corresponding to the received output;

wherein said resistor has a positive temperature dependence with respect to the absolute temperature.

* * * * *